US007059893B2

(12) United States Patent
Ono et al.

(10) Patent No.: US 7,059,893 B2
(45) Date of Patent: Jun. 13, 2006

(54) ELECTRIC CONNECTOR

(75) Inventors: Yasuhiro Ono, Tokyo (JP); Akiyoshi Oshitani, Saitama (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/192,271

(22) Filed: Jul. 29, 2005

(65) Prior Publication Data

US 2006/0025007 A1 Feb. 2, 2006

(30) Foreign Application Priority Data

Jul. 30, 2004 (JP) ..... P2004-222938

(51) Int. Cl.
*H01R 12/24* (2006.01)

(52) U.S. Cl. ..... 439/495; 439/260; 439/329

(58) Field of Classification Search ..... 439/260, 439/329, 495
See application file for complete search history.

(56) References Cited

U.S. PATENT DOCUMENTS

| | | | | |
|---|---|---|---|---|
| 4,734,053 | A * | 3/1988 | Imai | 439/329 |
| 5,240,430 | A | 8/1993 | Soes et al. | 439/260 |
| 5,906,504 | A * | 5/1999 | Igarashi et al. | 439/495 |
| 5,954,530 | A * | 9/1999 | Ichimura | 439/260 |
| 6,129,573 | A * | 10/2000 | Juntwait et al. | 439/329 |
| 6,210,209 | B1 * | 4/2001 | Wu et al. | 439/495 |
| 6,231,378 | B1 | 5/2001 | Wu et al. | 439/495 |
| 6,315,616 | B1 * | 11/2001 | Hayashi | 439/638 |
| 6,371,797 | B1 | 4/2002 | Kikuchi et al. | 439/496 |
| 6,520,797 | B1 * | 2/2003 | Okamura et al. | 439/495 |
| 2002/0132518 | A1 | 9/2002 | Kobayaski | 439/496 |
| 2003/0236024 | A1 | 12/2003 | Wu | 439/495 |

FOREIGN PATENT DOCUMENTS

| | | |
|---|---|---|
| JP | 7-22127 | 1/1995 |
| JP | 8-195256 | 7/1996 |
| JP | 9-283237 | 10/1997 |

* cited by examiner

*Primary Examiner*—Truc Nguyen
(74) *Attorney, Agent, or Firm*—Morgan, Lewis & Bockius LLP

(57) ABSTRACT

A socket body is formed with a recess elongated in a first direction. Socket contacts are disposed in the recess and arrayed in the first direction. A plug body is adapted to be fitted into the recess in a second direction perpendicular to the first direction. The plug body is formed with a groove extending in the first direction. Plug contacts, each of which includes a first contact piece and a second contact piece which are opposed to each other with a gap, are arrayed in the first direction such that the first contact piece is disposed in the groove and the second contact piece is disposed on an outer face of a side wall of the plug body to be electrically connected with one of the socket contacts. A flat wiring member has a first portion on which terminals are arrayed in the first direction, and which is inserted into the groove in the second direction such that each terminal is opposed to each first contact piece. A pressing member has a first part extending in the second direction, and attached to the plug body such that the first part is inserted into the groove, thereby pressing the first portion of the flat wiring member against the first contact piece in a third direction orthogonal to the first and second directions. The first and second contact pieces are resiliently deformable in the third direction, so that the first portion of the flat wiring member, the first part of the pressing member and the side wall of the plug body are resiliently clamped therebetween.

5 Claims, 11 Drawing Sheets

ELECTRIC CONNECTOR

BACKGROUND OF THE INVENTION

This invention relates to an electric connector suitably used for connecting a flexible flat-type wiring member (such as a flexible printed wiring board having a plurality of conductor patterns formed on an end portion thereof and a flexible flat cable) to a circuit board such as a printed circuit board and a flexible printed wiring board.

Flat-type wiring members (hereinafter referred to as "FPC"), which are thin and flexible and in which conductors can be provided at a small pitch, have been extensively used as wiring members in electronic equipments which have now been formed into a more compact design and a thinner design.

In one conventional method of connecting this FPC to a circuit board such as a printed circuit board (printed wiring board), a socket member is mounted on the circuit board, and a terminal portion of the FPC is soldered to a plug member which is adapted to be inserted into the socket member to be electrically connected thereto. In this method, however, the operation for soldering the FPC requires much labor and time, and therefore is not easy. In order to solve this problem, Japanese Patent Publication No. 7-22127A discloses an electric connector in which an FPC is connected to a plug member without the need for a soldering operation.

The structure disclosed in this publication includes: a plug member having a laterally-extending portion and a vertically extending portion so as to form a generally inverted L-shaped cross-section or a T-shaped cross-section; and plug contact pins provided in contiguous relation to a lower face of the laterally-extending portion and each side face of the vertically-extending portion; and a plug cover disposed in opposed relation to the laterally-extending portion of the plug member. The vertically-extending portion of the plug member is inserted into a socket member, and a terminal portion of an FPC is held between the plug cover and the laterally-extending portion of the plug member.

With this construction, the laterally-extending portion of the plug member presses generally V-shaped contact portions of laterally-extending portions of the plug contact pins. The laterally-extending portions of the plug contact pins can be brought into press-contact with the terminal portion of the FPC to be electrically connected thereto, and therefore the operation for connecting the plug contact pins to the terminal portion of the FPC can be easily carried out without the need for a cumbersome operation such as a soldering operation.

Japanese Patent Publication Nos. 8-195256A and 9-28323A disclose other examples which enable electrical connection without the need for soldering a terminal portion of an FPC. In these examples, a gap is formed in each contact pin, and the terminal portion of the FPC is inserted in this gap, and in this condition a pressing member is operated to be pivoted about one side portion of the gap serving as a fulcrum, so that the terminal portion is biased and pressed against an inner face of the other side portion of the gap. By thus operating the pressing member, the terminal portion of the FPC can be easily electrically connected to the contact pins.

In electronic equipments which have now been formed into a more compact design and a higher-density design, the structure of connecting a circuit board (such as a printed circuit board within these electronic equipments) to the FPC has been more and more required to have a thin (low-height) design and a multi-terminal design (i.e., increasing the number of terminals of the FPC). Naturally, it is desirable that this connecting operation can be carried out easily, and it is also desirable that the connecting structure, even when having the multi-terminal design, can meet the requirement of the thin design.

In the example disclosed in Japanese Patent Publication No. 7-22127A, in order to ensure the connection (electrical connection) of the FPC to the plug member, it is necessary to impart a certain press-contacting force (holding force) produced as a result of resilient deformation of the generally V-shaped contact portions of the laterally-extending portions of the plug contact pins to the connecting portion thereof. In the case of increasing the number of socket contact pins and the number of plug contact pins corresponding thereto (that is, in the case of providing a multi-terminal design), it is naturally necessary to increase the overall press-contacting force of the connector produced by all of the plug contact pins in proportion to the number of the plug contact pins.

However, the increased overall press-contacting force in this multi-terminal form incurs increased stresses acting on the laterally-extending portion of the plug member which is made longer in the direction of arrangement of the plug contact pins as a result of the multi-terminal design. Thus, the laterally-extending portion is subjected to a reaction force of the overall press-contacting force, and as a result there is a case that it is warped. Particularly, an intermediate portion of the laterally-extending portion remote from portions of the plug member which are retainingly engaged with the plug cover is raised. Therefore, the pressing force of the laterally-extending portion of the plug member, which is applied to the laterally-extending portions of the plug contact pins, is reduced, thereby making the electrical connection achieved by the press-contact unstable.

A simple method of preventing this disadvantage is to increase the thickness of the laterally-extending portion of the plug member (that is, the thickness between the upper and lower face of the laterally-extending portion). However, the increased thickness of this laterally-extending portion leads to an increased size of the plug member in the vertical direction, which makes it difficult for the connector to meet the requirement of the above-mentioned thin design.

In addition, the ability of retaining the FPC against withdrawal when a pulling force is applied laterally to the FPC held between the plug cover and the laterally-extending portion of the plug member is correlated with a frictional force of this retaining portion which is obtained by multiplying the above press-contacting force by a constant friction coefficient. On the other hand, a method of reducing the thickness of the laterally-extending portion of the plug member in the vertical direction is advantageously used for meeting the requirement of the above thin design. However, when the laterally-extending portion of the plug member is made thin, the rigidity of this laterally-extending portion is lowered, and the pressing force required to hold down the contact portions of the plug contact pins to be brought into press-contact with the terminal portion of the FPC, as well as the frictional force related thereto, is reduced. The reduced frictional force adversely affects the FPC-retaining function, and leads to adverse effects on the connecting reliability such as deviation of the connecting position and the accidental withdrawal of the FPC. Therefore, it is difficult to achieve the multi-terminal FPC-connecting electric connector which has a thin design and a high connecting reliability.

In the examples disclosed in Japanese Patent Publication Nos. 8-195256A and 9-283237A, the terminal portion of the FPC is caused to abut against the inner face of the other side portion of the gap of each contact pin by the force applied by the pressing member which is pivoted about the one side portion of the gap serving as a fulcrum. Therefore, the force to cause the terminal portion to abut against the contact pins will not vary in accordance with the arrangement position of the terminal portion as in the example disclosed in Japanese Patent Publication No. 7-22127A. However, even in these examples, the FPC-retaining ability depends only on the frictional force corresponding to the force to grip the terminal portion of the FPC, and therefore has been found not entirely sufficient.

SUMMARY OF THE INVENTION

It is therefore an object of this invention to provide an electric connector which enables an FPC to be easily connected thereto, and has a high connecting reliability though it has a thin structure.

In order to achieve the above object, according to the invention, there is provided an electric connector, comprising:

a socket member, comprising:

a socket body, formed with a recess elongated in a first direction; and a plurality of socket contacts, disposed in the recess and arrayed in the first direction;

a plug member, adapted to be fitted into the recess in a second direction which is perpendicular to the first direction, the plug member comprising:

a plug body, formed with a groove extending in the first direction; and a plurality of plug contacts, each of which includes a first contact piece and a second contact piece which are opposed to each other with a gap therebetween, the plug contacts being arrayed in the first direction such that the first contact piece is disposed in the groove and the second contact piece is disposed on an outer face of a side wall of the plug body to be electrically connected with one of the socket contacts;

a flat wiring member, having a first portion on which a plurality of terminals are arrayed in the first direction, and which is inserted into the groove in the second direction such that each of the terminals is opposed to the first contact piece of one of the plug contacts; and a pressing member, having a first part extending in the second direction, and attached to the plug body such that the first part is inserted into the groove, thereby pressing the first portion of the flat wiring member against the first contact piece in a third direction which is orthogonal to the first direction and the second direction, wherein the first contact piece and the second contact piece are resiliently deformable in the third direction, so that the first portion of the flat wiring member, the first part of the pressing member and the side wall of the plug body are resiliently clamped between the first contact piece and the second contact piece.

Preferably, the pressing member has a second part continued from the first part thereof and extending in the third direction. Here, the flat wiring member has a second portion which is continued from the first portion thereof and is disposed below the second part of the pressing member.

Here, it is preferable that the pressing member is a conductive member and has a third part continued from the second part so as to extend in the third direction; and the socket member comprises a conductive retainer adapted to engage with the third part of the pressing member when the plug member is fitted with the socket member.

It is further preferable that the flat wiring member has a first face on which the terminals are arrayed, and a second face opposing to the pressing member and having a conductive layer formed on the first portion and the second portion thereof.

It is still further preferable that the flat wiring member includes a region extending in the first direction, in which the conductive layer is partly removed.

With the above configurations, the flat wiring member can be easily connected thereto without soldering even when the thickness of the second part of the pressing member is not so large, and the function of retaining the connected flat wiring member is enhanced. Therefore the connecting reliability of the electric connector can be enhanced while reducing the size of the electric connector in the second direction.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the present invention will be described below in detail with reference to the accompanying drawings.

Figure 1:
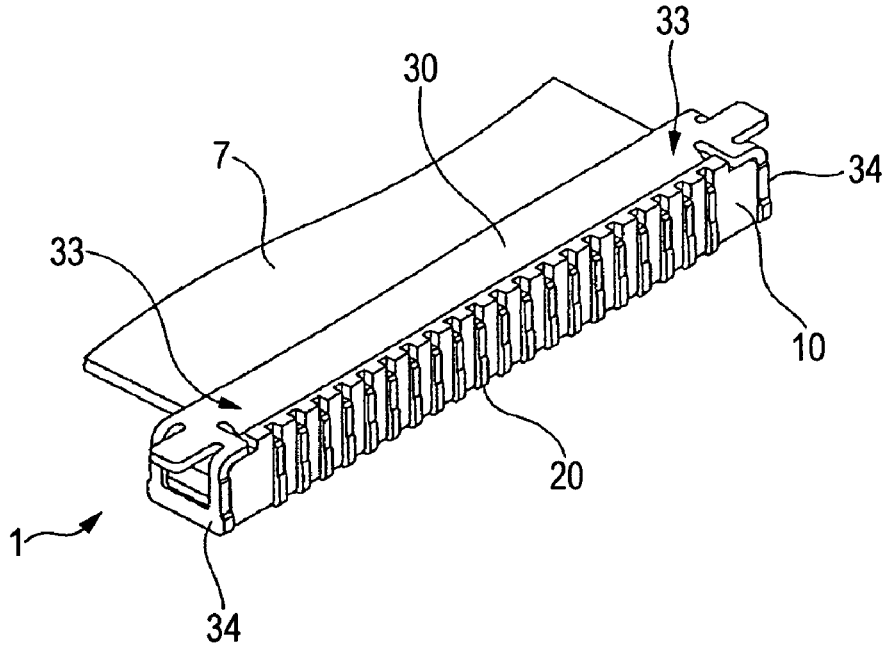
FIG. 1 is a perspective view of a plug member of an electric connector according to one embodiment of the invention, showing a condition that a flat-type wiring member is connected to the plug member.

As shown in FIG. 1, a plug member 1 to which an FPC 7 is connected comprises an elongated plug body 10 made of synthetic resin; a plurality of plug contacts 20 arranged at a predetermined pitch in a longitudinal direction of the plug body; and a pressing member 30 which has extended pieces 34 extending respectively from opposite end portions 33 thereof, and is attached to an upper side of the plug body 10 to partially cover the FPC 7.

Figure 2:
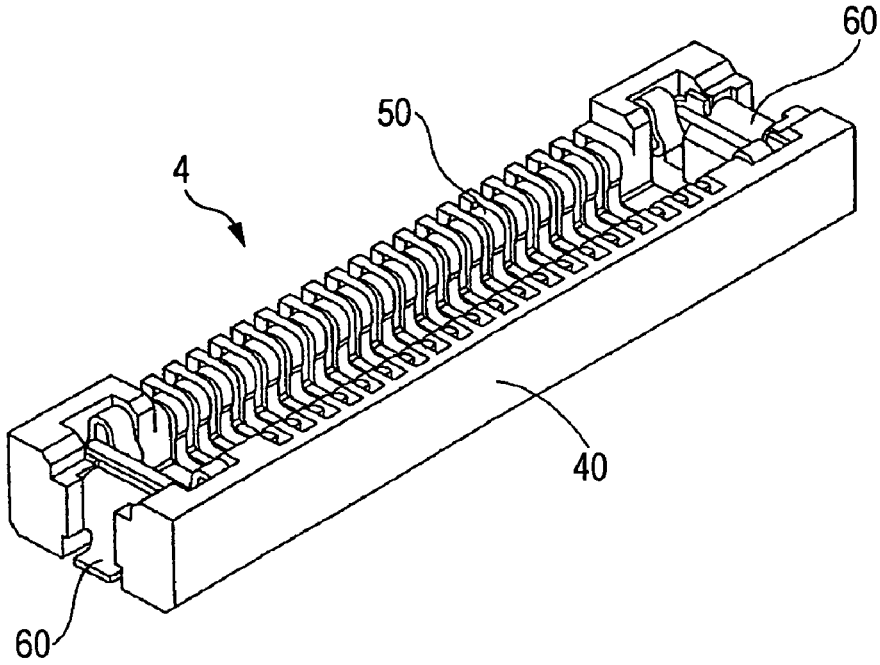
FIG. 2 is a perspective view of a socket member of the electric connector.

As shown in FIG. 2, the socket member 4 comprises: an elongated socket body 40 made of a synthetic resin; a plurality of socket contacts 50 arranged at a predetermined pitch in a longitudinal direction of the socket body in corresponding relation to the arrangement of the plug contacts 20 of the plug member 1; and the plug retainer 60 attached respectively to opposite ends of the socket body so as to correspond respectively to the extended pieces 34 of the pressing member 30.

Figure 3A:
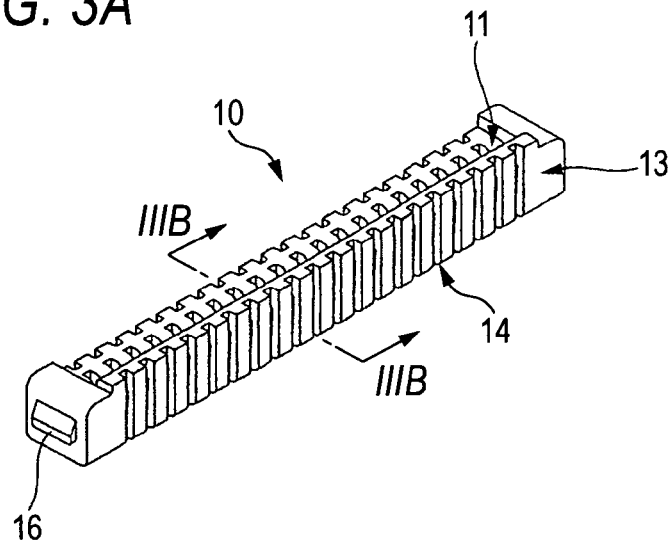
FIG. 3A is a perspective view of a plug body of the plug member.
Figure 3B:
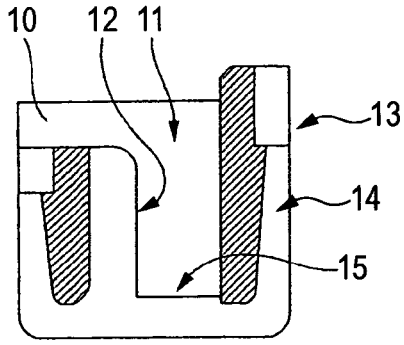
FIG. 3B is a section view taken along a line IIIB—IIIB in FIG. 3A.

As shown in FIGS. 3A and 3B, a groove 11 is formed in the plug body 10 and extends between the vicinities of opposite ends thereof in the longitudinal direction. The groove 11 is open upwardly such that a bottom 15 of this groove 11 can be viewed from the upper side. Positioning grooves 14 for arranging the plug contacts 20 at the predetermined pitch are formed in an outer face 13 and an inner wall 12 of the plug body 10.

Figure 4:
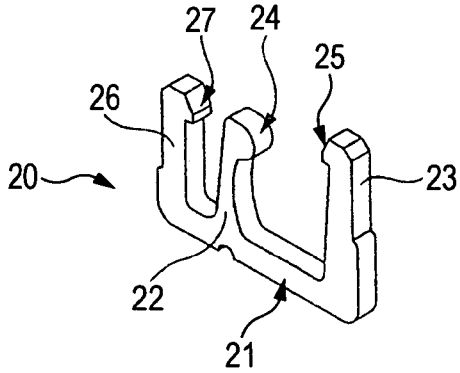
FIG. 4 is a perspective view of a plug contact of the plug member.

The plug contact 20 is blanked from a thin metal sheet having good electrical conductivity and spring properties. As shown in FIG. 4, the plug contact 20 includes a beam portion 21 connecting a first piece 22, a second piece 23 and a third piece 26. Projections 24 and 25 are formed respectively at distal ends of the first piece 22 and the second piece 23. When a force is applied to move the projections 24 and 25 away from each other, the first and second pieces 22 and 23 are resiliently deformed away from each other to thereby produce resilient restoration forces respectively for urging the two pieces 22 and 23 toward each other.

Figure 5A:
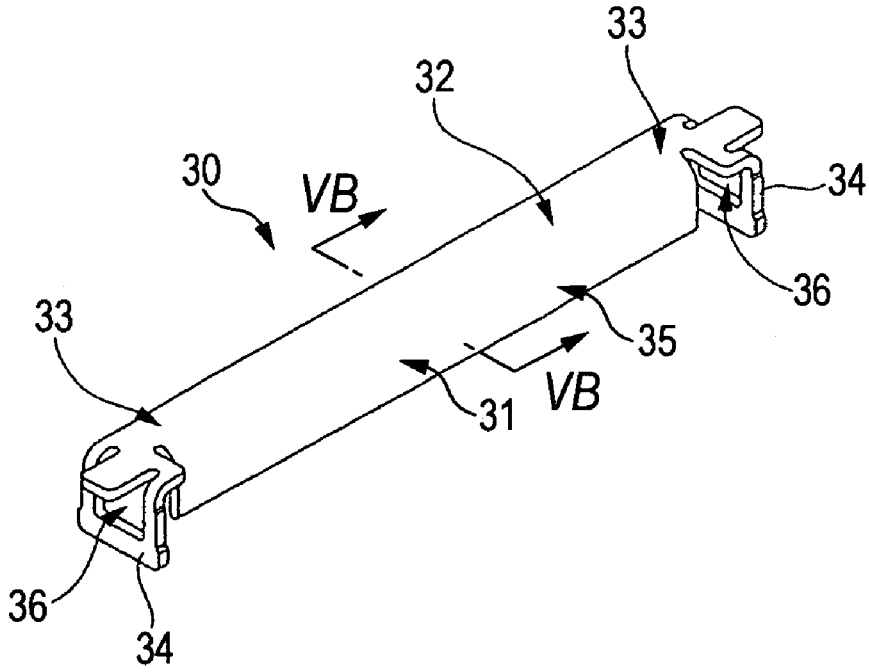
FIG. 5A is a perspective view of a pressing member of the plug member.
Figure 5B:
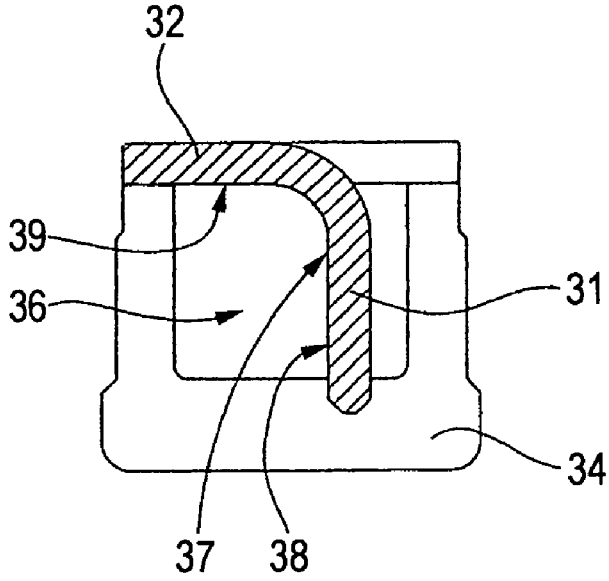
FIG. 5B is a section view taken along a line VB—VB in FIG. 5A.

The pressing member 30 is formed by blanking a piece from a thin metal sheet having electrical conductivity and then by bending it into a predetermined shape. As shown in FIGS. 5A and 5B, the pressing member 30 includes a laterally-extending portion 32, and a vertically-extending portion 31 extending perpendicularly from the laterally-extending portion 32 such that a vertical face 38 and a horizontal face 39 of an inner face 37 are disposed perpendicular to each other. A length of the vertically-extending portion 31 is slightly smaller than a length of the groove 11 of the plug body 10. The extended pieces 34, each having a window 36, extend downwardly from the opposite end portions 33 of the laterally-extending portion 32, respectively.

Figure 6:
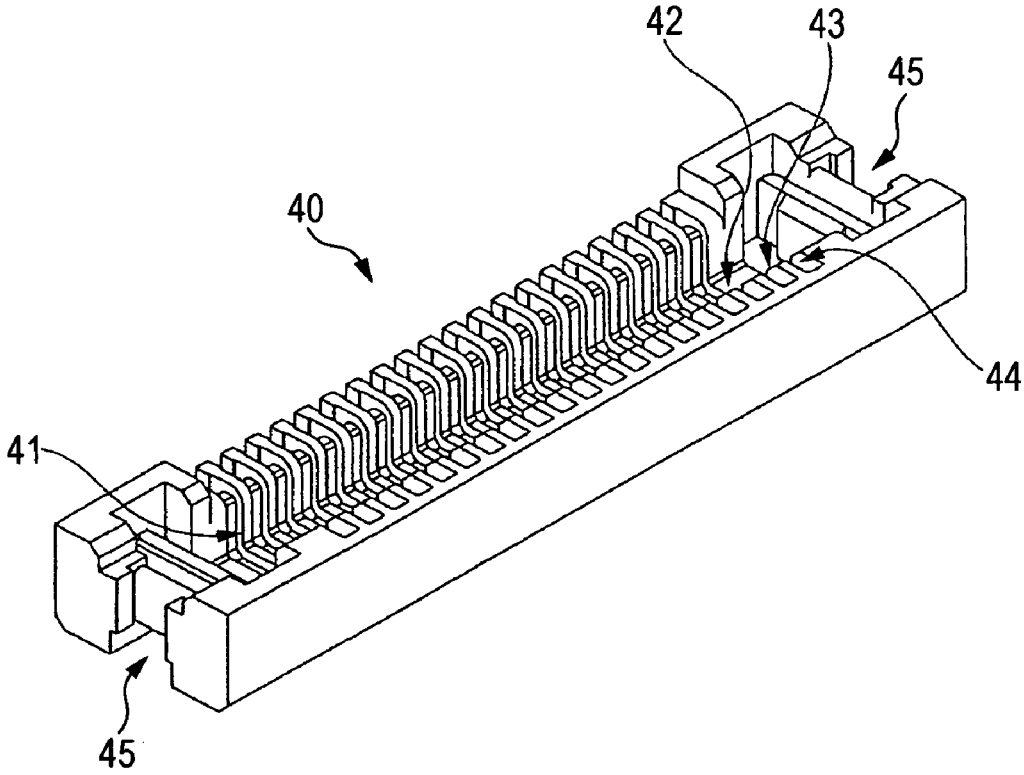
FIG. 6 is a perspective view of a socket body of the socket member.

As shown in FIG. 6, an elongated recess for receiving a lower portion of the plug member 1 is formed in the socket body 40, and is open upwardly such that a bottom 42 of this elongated recess can be viewed from the upper side. Positioning grooves 44 for arranging the socket contacts 50 at the predetermined pitch corresponding to the arrangement pitch of the plug contacts 20 are formed in an inner face 43 of the elongated recess 41. Mounting grooves 45 are formed in the opposite ends of the socket body 40, respectively, and the plug retainer 60 are mounted in these mounting grooves 45, respectively.

Figure 7:
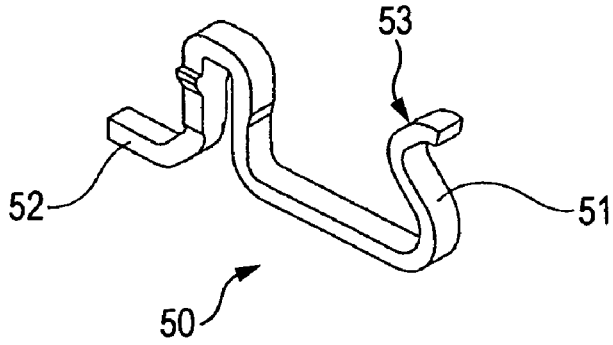
FIG. 7 is a perspective view of a socket contact of the socket member.

The socket contact 50 is blanked from a thin metal sheet having good electrical conductivity and spring properties. As shown in FIG. 7, the socket contact 50 includes a resilient piece 51 and a laterally-extending tail 52. When the socket member 4 is mounted on a circuit board, the tail 52 is connected and fixed to this circuit board by soldering or the like.

Figure 8A:
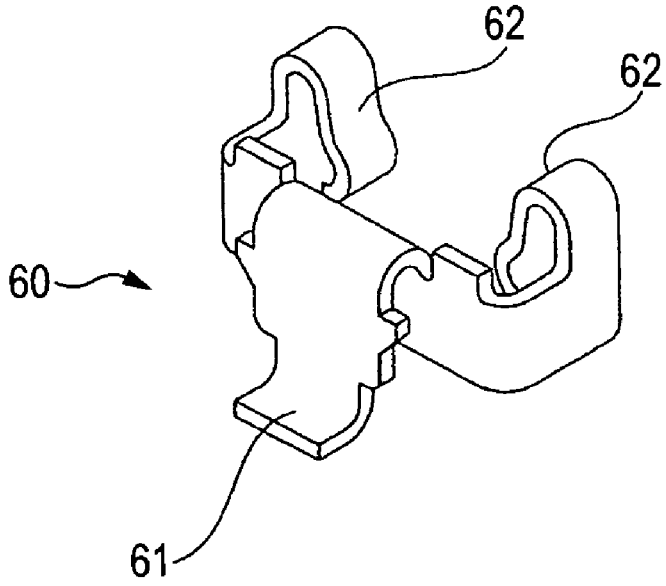
FIGS. 8A and 8B are perspective views of a plug retainer of the socket member.
Figure 8B:
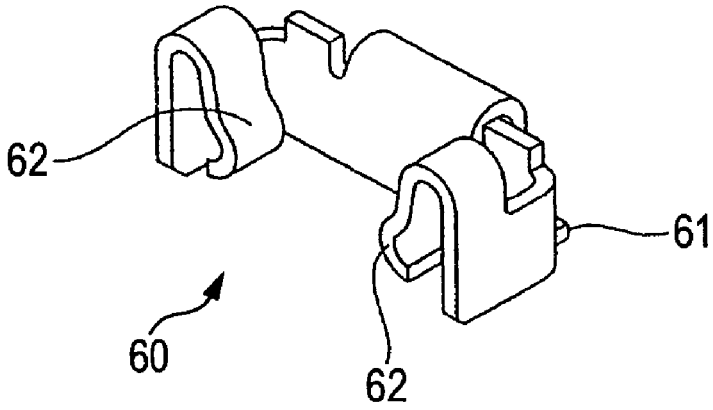

The plug retainer 60 is formed by blanking a piece from a thin metal sheet having electrical conductivity and then by bending it into a predetermined shape. As shown in FIGS. 8A and 8B, the plug retainer 60 includes a pair of opposed retaining pieces 62 and a laterally-extending tail 61. When the socket member 4 is mounted on the circuit board, the tail 61 is connected and fixed to this circuit board (and is electrically connected thereto if necessary) by soldering or the like. The distance between the retaining pieces 62 is so determined that they can be engaged with the extended piece 34 of the pressing member 30 when the plug member is inserted and fitted in the socket member. Preferably, the extended piece 34 can be held between the retaining pieces 62.

Figure 9A:
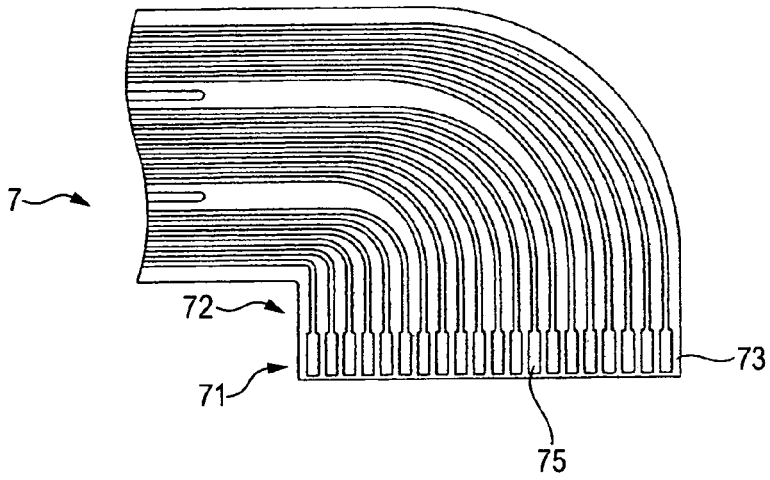
FIG. 9A is a bottom plan view of the flat-type wiring member.
Figure 9B:
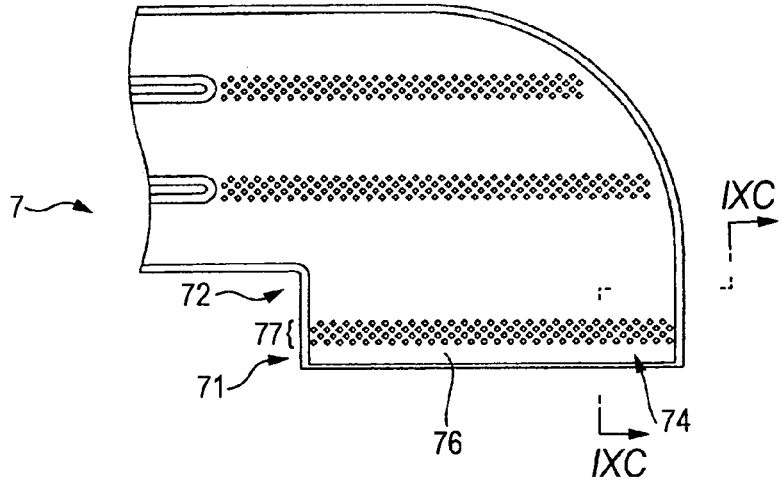
FIG. 9B is a top plan view of the flat-type wiring member.
Figure 9C:
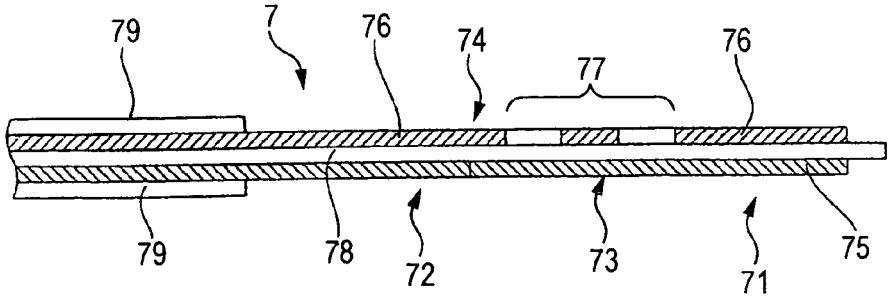
FIG. 9C is a section view taken along a line IXC—IXC in FIG. 9B.

As shown in FIGS. 9A to 9C, the FPC 7 comprises: a base layer 78 composed of a synthetic resin film; covering layers 79 made of an insulative material; and conductor layers composed of a copper foil. Conductor patterns 75 serving as connection terminals are formed on a first side 73 of the end portion 71 of the FPC, and are arranged at a pitch corresponding to the arrangement pitch of the plug contacts 20 of the plug member 1, while the conductor layer 76 is formed in a laminated manner on a second side 74 substantially over an entire area thereof. A softened region 77 is formed between the end portion 71 and an extended portion 72 at the second side 74, and extends generally linearly in a direction of the width of the end portion 71 (that is, in the lateral direction in FIG. 9B). In the softened region 77, a number of small holes are formed through the conductor layer 76 while maintaining the electrical conductivity thereof, thus partially removing the conductor layer 76. The FPC can be bent more easily at this softened region 77 as compared with the end portion 71 and the extended portion 72 since the area of formation of the copper foil is smaller, so that the influence of the hardness due to its stiffness is low.

Figure 10:
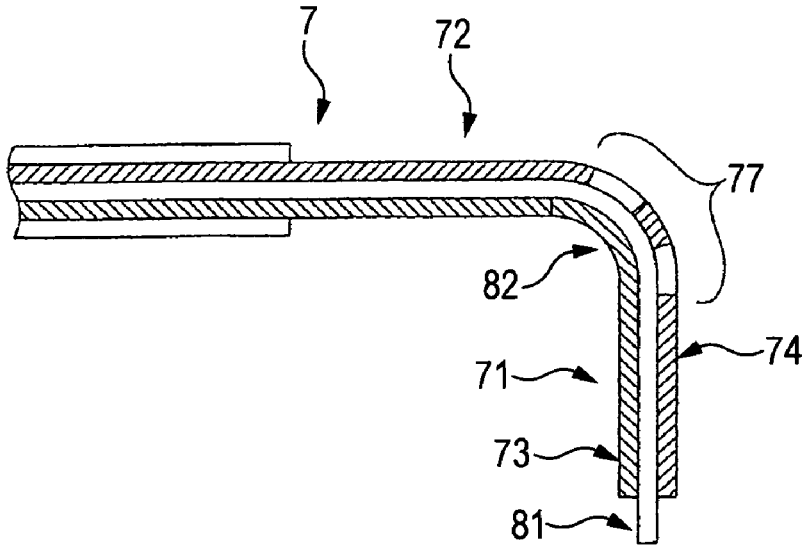
FIG. 10 is a section view of the flat-type wiring member, showing a condition that the flat-type wiring member is bent at softened region.

As shown in FIG. 10, the FPC 7 is bent at a generally central portion of the softened region 77 serving as a bending portion 82 in such a manner that the end portion 71 and the extension portion 72 are disposed generally perpendicular to each other, and in this condition a length from the bending portion 82 to a distal end 81 of the FPC 7 is generally equal to the depth of the groove 11 of the plug body 10. With this construction, the bending portion 82 can be easily formed at an arbitrary portion of the FPC 7.

Figure 11:
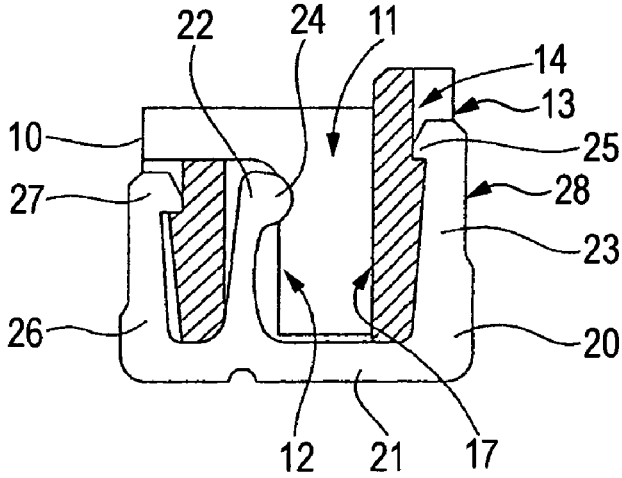
FIG. 11 is a section view showing a condition that the plug contact is mounted on the plug body.

As shown in FIG. 11, the plug contact 20 is attached to the plug body 10 from the lower side thereof, and as a result the projection 24 of the first piece 22 projects from a first inner wall 12 of the groove 11, and also the second piece 23 is guided by the positioning groove 14 in such a manner that a portion 28 is exposed from an outer face 13, and the projection 25 of the second piece 23 and a projection 27 of the third piece 26 clamp the plug body 10. In this condition, the distance (or gap) between the projection 24 and a second inner wall 17 which are opposed to each other is slightly smaller than the sum of the thickness of the end portion 71 of the FPC 7 and the thickness of the vertically-extending portion 31 of the pressing member 30. The first piece 22 can be resiliently displaced in the lateral direction because of a spring function of the beam portion 21.

Figure 12A:
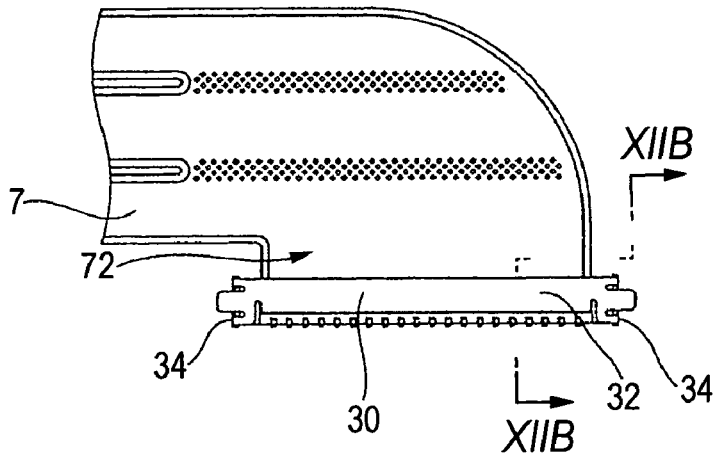
FIG. 12A is a top plan view showing a condition that the flat-type wiring member is connected to the plug member.
Figure 12B:
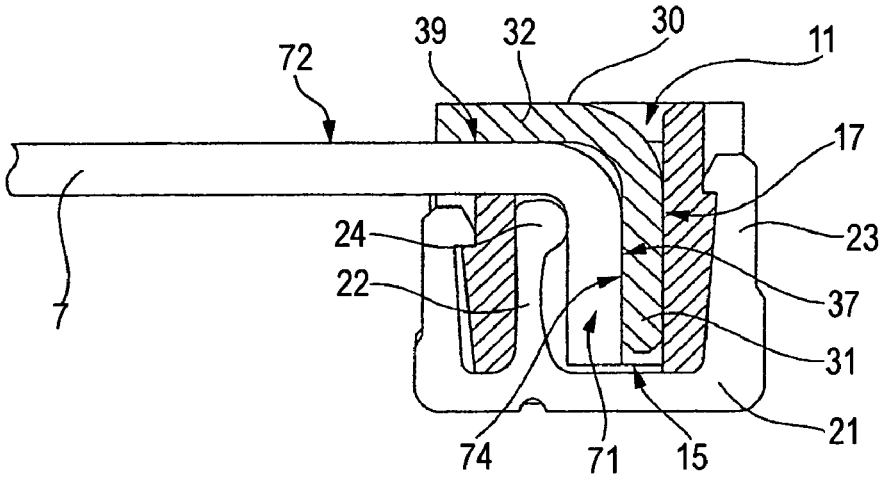
FIG. 12B is a section view taken along a line XIIB—XIIB in FIG. 12A.

As shown in FIGS. 12A and 12B, the end portion 71 of the FPC 7 is inserted into the groove 11 from the upper side thereof, and is directed toward the bottom 15. In addition, the vertically-extending portion 31 of the pressing member 30 is inserted into the groove 11 from the upper side thereof, and is directed toward the bottom 15. The vertically-extending portion 31, inserted in the gap between the second side 74 of the end portion 71 and the second inner wall 17 of the groove 11, presses the first pieces 22 of the plug contacts 20 in the lateral direction together with the end portion 71. In this condition, the end portion 71 is firmly held between the vertically-extending portion 31 and the first pieces 22 with the aid of the urging forces from the second pieces 23 derived from the resilient spring function of the beam portion 21. In this condition, the conductor patterns 75 formed on the end portion 71 can be electrically connected respectively to the plug contacts 20 without soldering, and the conductor layer 76 formed on the end portion 71 can be electrically connected to the pressing member 30 without soldering.

Since the end portion 71 of the FPC 7 is pressed against the first piece 22 of each plug contact 20 in the lateral direction by the inserted vertically-extending portion 31, it is not necessary to increase the thickness of the laterally-extending portion 32 in order to cope with the increase of the pressing force. Accordingly, the thickness (the size in the vertical direction) of the plug member 1 can be reduced. And besides, the laterally-extending portion 32, disposed to partially cover the extended portion 72, prevents the extension portion 32 from being raised in the upward direction in FIG. 12B. Furthermore, even when an external force (for example, in the lateral direction in FIG. 12B) is accidentally applied to the FPC 7, which has been inserted in the groove 11, and bent at the softened region 77 such that the end portion 71 and the extended portion 72 are disposed in contiguous relation to the inner face 37 of the pressing member 30, the end portion 71 is caught by the first inner wall 12 and the projections 24 of the first pieces 22 of the plug contacts 20, so that the FPC 7 will not be easily disengaged from the plug member 1.

Figure 13:
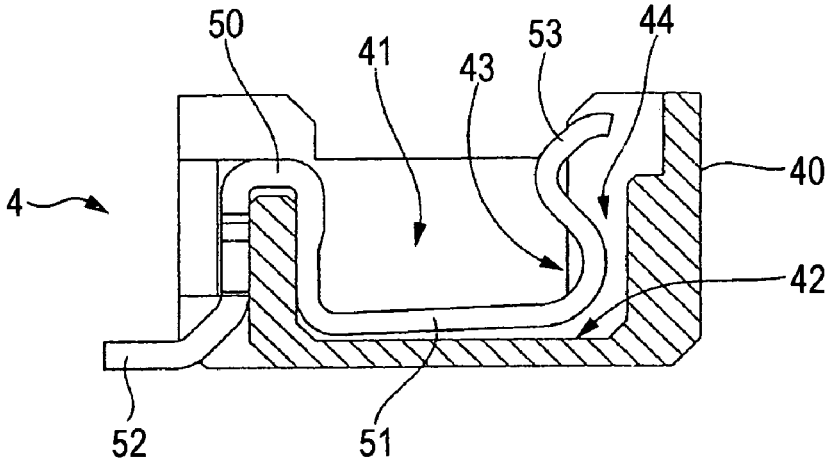
FIG. 13 is a section view showing a condition that the socket contact is mounted on the socket body.

As shown in FIG. 13, each socket contact 50 is mounted in the socket body 40 in such a manner that a projection 53, formed at the distal end portion of the resilient piece 51, projects from an inner face 43 of the elongated recess and that the tail 52 projects from an outer face of the socket body 40. In this condition, the projection 53 of the resilient piece 51 can be resiliently displaced in the lateral direction, that is, in such a direction that spreads the resilient piece 51.

Figure 14:
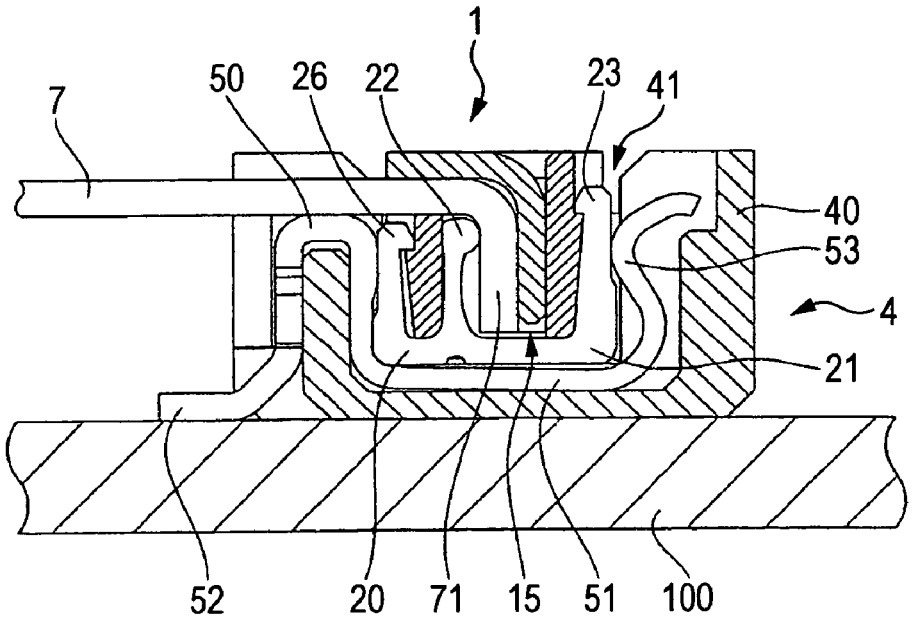
FIG. 14 is a section view showing a condition that the plug member having the FPC connected thereto is fitted into the socket member.

As shown in FIG. 14, the plug member 1 is inserted into the elongated recess of the socket body 40, with the bottom 15 directed downward, and is fitted in the socket member 4 in such a manner that the resilient piece 51 of each socket contact 50 clamps the second piece 23 and third piece 26 of the corresponding plug contact 20. In this condition, the projection 53 of the resilient piece 51, resiliently displaced in the lateral direction, presses the second piece 23 by its resilient force produced by the resilient spring function of the resilient piece 51, so that the plug contact 20 and the socket contact 50 plug member 1 is substantially completely received within the socket member 4, the height of the electric connector (from the upper face of the circuit board 100 to the top face of the plug member 1) in its completely-assembled condition can be reduced.

Figure 15:
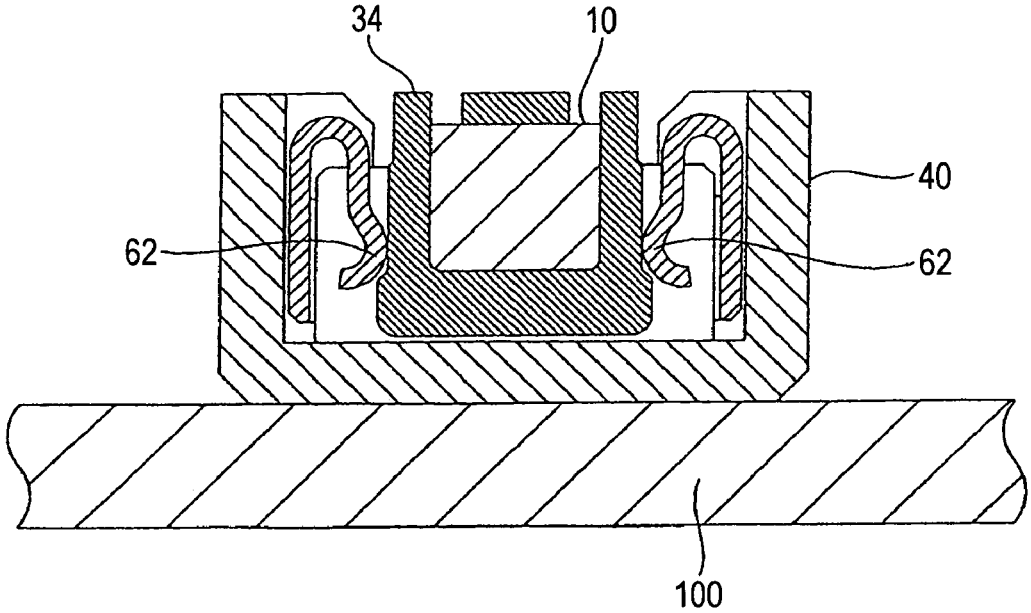
FIG. 15 is a section view showing a condition that the pressing member of the plug member is fitted into the plug retainer of the socket member.

In this fitted condition, as shown in FIG. 15, each extended piece 34 of the pressing member 30 is interposed between (or engaged with) the retaining pieces 62 of the corresponding plug retainer 60, and with this construction the conductor layer 76 of the FPC 7 can be electrically connected to the plug retainer 60 via the pressing member 30. In the case where the conductor layer 76 serves as a shielding layer, a connection form with good transmission characteristics (such for example as the ability of controlling impedance characteristics with respect to the conductor patterns 75 and the conductor layer 76) can be easily achieved, utilizing this shielding function. For example, by connecting the tails 61 of the plug retainer 60 to a grounding circuit on the circuit board 100, the conductor layer 76 serves as the shielding layer.

Figure 16A:
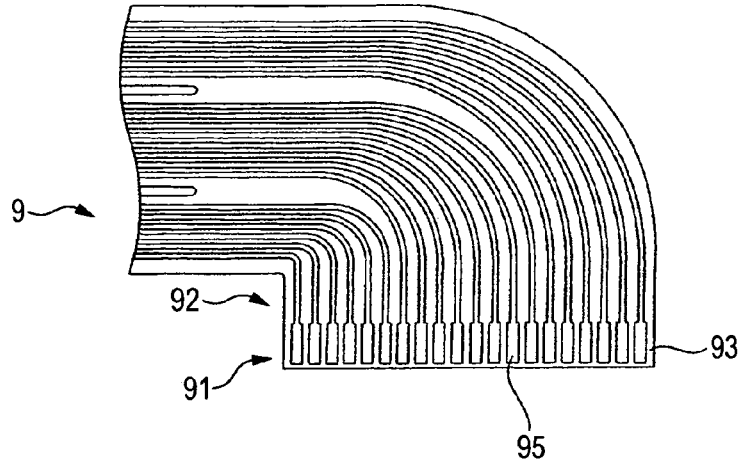
FIG. 16A is a bottom plan view of another example of the flat-type wiring member.
Figure 16B:
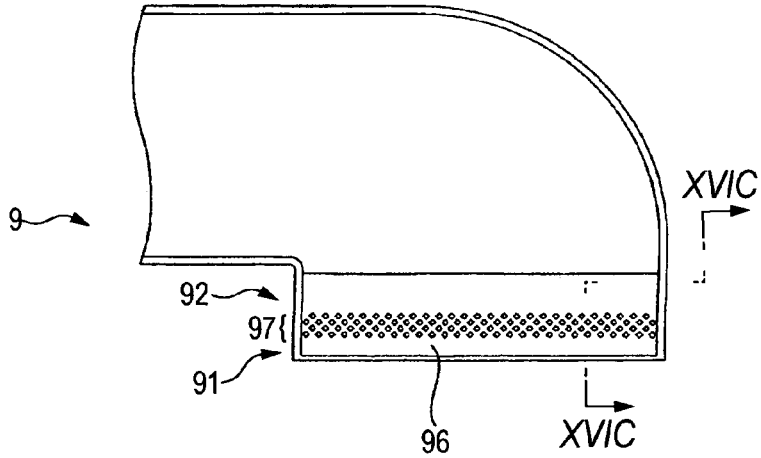
FIG. 16B is a top plan view of the flat-type wiring member of FIG. 16A.
Figure 16C:
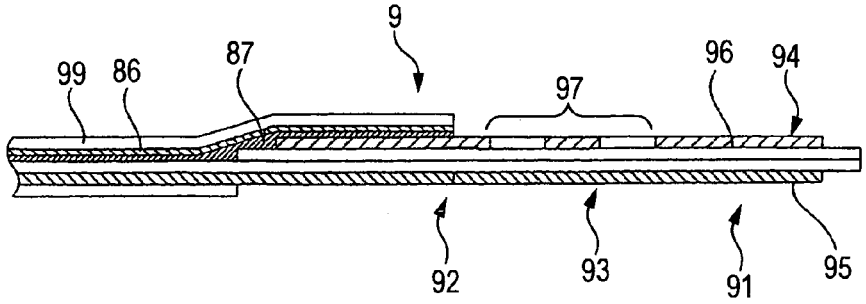
FIG. 16C is a section view taken along a line XVIC—XVIC in FIG. 16B.

FIG. 16 shows another example of an FPC suitably used in the electric connector of the invention. In this FPC 9, a softened region 97 is formed between an end portion 91 and an extended portion 92 at a second side 94 as in the case shown in FIG. 9B. At the extension portion 92, a first conductor layer 96 is connected to a very thin second conductor layer 86, which is formed on a lower face of a covering layer 99 (for example, by evaporation coating), by an electrically-conductive adhesive 87.

With this configuration that the two conductor layers of different kinds are connected together, characteristics (such for example as flexibility) of that portion of the FPC 9 extending further from the extension portion 92 can be made different from the characteristics of the end portion 91. For example, the thickness of the second conductor layer 86 is made smaller than the thickness of the conductor layer 96 so that the end portion 91 of higher rigidity can be effectively caught by the plug member 1 when the FPC 9 is connected to the plug member 1. By doing so, the FPC 9 can easily meet various conditions of use of an electronic equipment within which the FPC 9 is installed. For example, the FPC is installed at such a region of this equipment where the FPC is required to be bent or flexed at many portions thereof, and therefore is required to be very flexible.

In the above embodiment, the pressing member 30 is formed of the thin metal sheet, however, it can be made of a synthetic resin or the like. In addition, the cross-sectional shape of the pressing member 30 defined by the vertically-extending portion 31 and the laterally-extending portion 32 is not limited to the generally inverted L-shape, but can take any other suitable shape such as a generally T-shape in so far as the vertically-extending portion 31 can have desired rigidity. Although the laterally-extending portion 32 need only to partially cover the extended portion 72 (that is, that portion of the extended portion 72 near to the perpendicularly-bent portion of the FPC 7), the laterally-extending portion 32 can be so modified as to cover substantially the whole of the extended portion 72.

In the above embodiments, a large number of small holes are formed through the conductor layer 76, 96 to provide the softened region 77, 97 at the FPC 7, 9, however, the softened region can be formed, using a number of slots formed through the conductor layer or by forming the conductor layer into a lattice or a mesh structure in so far as the conductor layer 76, 96 can serve as a shielding layer, and enables the FPC to be easily bent.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An electric connector, comprising:

a socket member, comprising:

a socket body, formed with a recess elongated in a first direction; and a plurality of socket contacts, disposed in the recess and arrayed in the first direction;

a plug member, adapted to be fitted into the recess in a second direction which is perpendicular to the first direction, the plug member comprising:

a plug body, formed with a groove extending in the first direction; and a plurality of plug contacts, each of which includes a first contact piece and a second contact piece which are opposed to each other with a gap therebetween, the plug contacts being arrayed in the first direction such that the first contact piece is disposed in the groove and the second contact piece is disposed on an outer face of a side wall of the plug body to be electrically connected with one of the socket contacts;

a flat wiring member, having a first portion on which a plurality of terminals are arrayed in the first direction, and which is inserted into the groove in the second direction such that each of the terminals is opposed to the first contact piece of one of the plug contacts; and a pressing member, having a first part extending in the second direction, and attached to the plug body such that the first part is inserted into the groove, thereby pressing the first portion of the flat wiring member against the first contact piece in a third direction which is orthogonal to the first direction and the second direction, wherein the first contact piece and the second contact piece are resiliently deformable in the third direction, so that the first portion of the flat wiring member, the first part of the pressing member and the side wall of the plug body are resiliently clamped between the first contact piece and the second contact piece.

2. The electric connector as set forth in claim 1, wherein:

the pressing member has a second part continued from the first part thereof and extending in the third direction; and the flat wiring member has a second portion which is continued from the first portion thereof and is disposed below the second part of the pressing member.

3. The electric connector as set forth in claim 2, wherein:

the pressing member is a conductive member and has a third part continued from the second part so as to extend in the third direction; and the socket member comprises a conductive retainer adapted to engage with the third part of the pressing member when the plug member is fitted with the socket member.

4. The electric connector as set forth in claim 3, wherein the flat wiring member has a first face on which the terminals are arrayed, and a second face opposing to the pressing member and having a conductive layer formed on the first portion and the second portion thereof.

5. The electric connector as set forth in claim 4, wherein the flat wiring member includes a region extending in the first direction, in which the conductive layer is partly removed.

* * * * *